United States Patent [19]

Mathgen et al.

[11] 4,457,002

[45] Jun. 26, 1984

[54] ELECTRODE SEAL ASSEMBLY FOR METALLURGICAL FURNACE

[75] Inventors: Georges Mathgen; Robert Scherer, both of Luxembourg; Charles Prüm, Dudelange; Roger Leick, Hostert, all of Luxembourg

[73] Assignee: Arbed S.A., Luxembourg, Luxembourg

[21] Appl. No.: 486,842

[22] Filed: Apr. 20, 1983

[30] Foreign Application Priority Data

Apr. 22, 1982 [LU] Luxembourg ..... 84104

[51] Int. Cl.[3] ..... H05B 7/12

[52] U.S. Cl. ..... 373/95; 373/96

[58] Field of Search ..... 373/95, 96, 37, 38, 373/130; 277/12, 16, 22, 30, 31, 226

[56] References Cited

U.S. PATENT DOCUMENTS

| | | | |
|---|---|---|---|
| 2,243,096 | 5/1941 | Hardin | 373/95 |
| 2,979,550 | 4/1961 | Sherman, Sr. | 373/95 |
| 3,709,506 | 1/1973 | Beerman | 373/95 |
| 4,377,289 | 3/1983 | Lefebvre | 373/95 X |

FOREIGN PATENT DOCUMENTS

| | | | |
|---|---|---|---|
| 463414 | 2/1950 | Canada | 373/95 |

*Primary Examiner*—Roy N. Envall, Jr.

*Attorney, Agent, or Firm*—Michael J. Striker

[57] ABSTRACT

A seal for use around a rod electrode passing along an axis through a hole in the wall of a furnace into the interior of the furnace has an annular and at least limitedly flexible seal ring fitted snugly around the electrode in the hole and a holder carrying the seal ring and sealingly engaged with the furnace wall. Thus gas flow through the wall at the hole past the seal ring is substantially blocked. The seal assembly has structure forming with the electrode and seal ring a substantially closed chamber surrounding the electrode axially inward into the furnace from the ring. This chamber is pressurized at superatmospheric pressure with an inert gas and the electrode is cooled inward of the furnace from the seal ring. The seal ring is compressed axially by a packing assembly so it is pressed radially against the electrode. The packing includes rigid split compression rings bearing axially on the seal ring.

16 Claims, 1 Drawing Figure

ELECTRODE SEAL ASSEMBLY FOR METALLURGICAL FURNACE

BACKGROUND OF THE INVENTION

The present invention relates to an electrode seal assembly for a metallurgical furnace. More particularly this invention concerns a seal for use where a carbon electrode passes through the wall of a gas-tight furnace used for electric-arc refining and the like.

It is standard practice to operate an electric-arc furnace or the like in a special gas. Such a furnace has a single gas vent that is controlled by an automatic valve that maintains a predetermined pressure in the furnace.

Obviously leakage cannot be permitted at the holes in the furnace wall where the electrodes project into the interior of the furnace, these electrodes normally being relatively large cylindrical graphite rods. Since the electrodes are slowly consumed at their inner ends by the process, it is essential also that they be axially displaceable inward through the furnace wall.

The seal assembly must be as small as possible. Hence it cannot carry extensive shielding and will be exposed to the high heat in the furnace. As a result the adjustable components of the seal assembly degrade quickly. When robust parts are used the seal becomes too large and normally does not seal tightly.

SUMMARY OF THE INVENTION

It is therefore an object of the present invention to provide an improved seal assembly for a metallurgical furnace.

Another object is the provision of such a seal assembly for a metallurgical furnace which overcomes the above-given disadvantages.

A further object is to provide a seal assembly which has a long service life, which allows the electrodes to be changed relatively easily, and which forms a very tight joint.

These objects are attained according to the instant invention in a seal for use around a rod electrode passing along an axis through a hole in the wall of a furnace into the interior of the furnace which has an annular and at least limitedly flexible seal ring fitted snugly around the electrode in the hole and a holder carrying the seal ring and sealingly engaged with the furnace wall. Thus gas flow through the wall at the hole past the seal ring is substantially blocked. The seal assembly has structure forming with the electrode and seal ring a substantially closed chamber surrounding the electrode axially inward into the furnace from the ring. This chamber is pressurized at superatmospheric pressure with a gas and the electrode is cooled inward of the furnace from the seal ring.

The overpressure chamber prevents leakage very effectively. When an inert gas like nitrogen is used in the chamber the seal ring is effectively protected against oxidation. In addition the cooling of the electrode inward of the furnace, that is toward its hot interior, eliminates the deleterious effects of the furnace heat on the seal ring.

This seal ring according to this invention is compressed axially by a packing assembly so it is pressed radially against the electrode. Normally according to this invention the seal ring includes two axially stacked such rings, of carbon normally in the form of graphite fibers.

The packing means according to the invention includes rigid compression rings bearing axially on the seal ring. These compression rings are split. In addition they are releasably attached to the furnace wall so they can be removed with an electrode, making it relatively easy to switch electrodes. A fresh seal ring with its packing rings is fitted to the new electrode, then the old electrode with its seal ring and packing rings is removed and the new one fitted in its place. There is therefore no need to wait for the electrode to cool down completely, so down time is greatly reduced.

According to another feature of this invention the structure defining the overpressure chamber includes a containment ring inward of the furnace from the seal ring and radially engaging the electrode. This containment ring need not form as tight a seal as the seal ring, since limited leakage into the furnace of the inert gas in the chamber will not be harmful. The containment ring will be further into the furnace, and therefore exposed to considerable more harm than the seal ring. Thus it can be generally equiangularly divided into a plurality of parts engaging radially against the electrode. These parts can all be quite rigid and be carried on an inclined surface to be urged by their own weight against the electrode.

In accordance with another feature of the invention the structure forming the overpressure chamber further includes a sleeve or support ring carrying and extending axially between the seal and containment rings. Thus the chamber is delimited radially toward the axis by the electrode, radially away from the axis by the sleeve, axially inward of the furnace by the containment ring, and axially outward of the furnace by the seal ring.

The cooling means of the instant invention includes an annular jacket surrounding the electrode inward of the furnace from the chamber and means for circulating a coolant through the jacket. The jacket is cylindrically tubular and hollow and is provided internally with a spiral passage through which the coolant is passed. This jacket spacedly surrounds the electrode. Such a system insures that all the parts immediately adjacent the relatively fragile seal rings are cool.

The seal of this invention further comprises a shield ring inward of the furnace along the electrode from the chamber and cooling means and radially engaging the electrode. Thus the shield ring protects the cooling means from radiant heat. The shield ring in turn is formed of a plurality of pivotal ring parts radially engaging the electrode. These parts are weighted to pivot against the electrode, so their structure is quite simple.

In addition the seal assembly according to this invention has a rugged shield tube extending inward into the furnace around the electrode from the holder and containing the structure forming the chamber and the cooling means. The shield ring is carried on the inner end of the shield tube. Thus all the structure is well protected.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE is an axial and partly diagrammatic section through the seal assembly according to the present invention.

DESCRIPTION OF THE PREFERRED EMBODIMENTS

Figure 1:
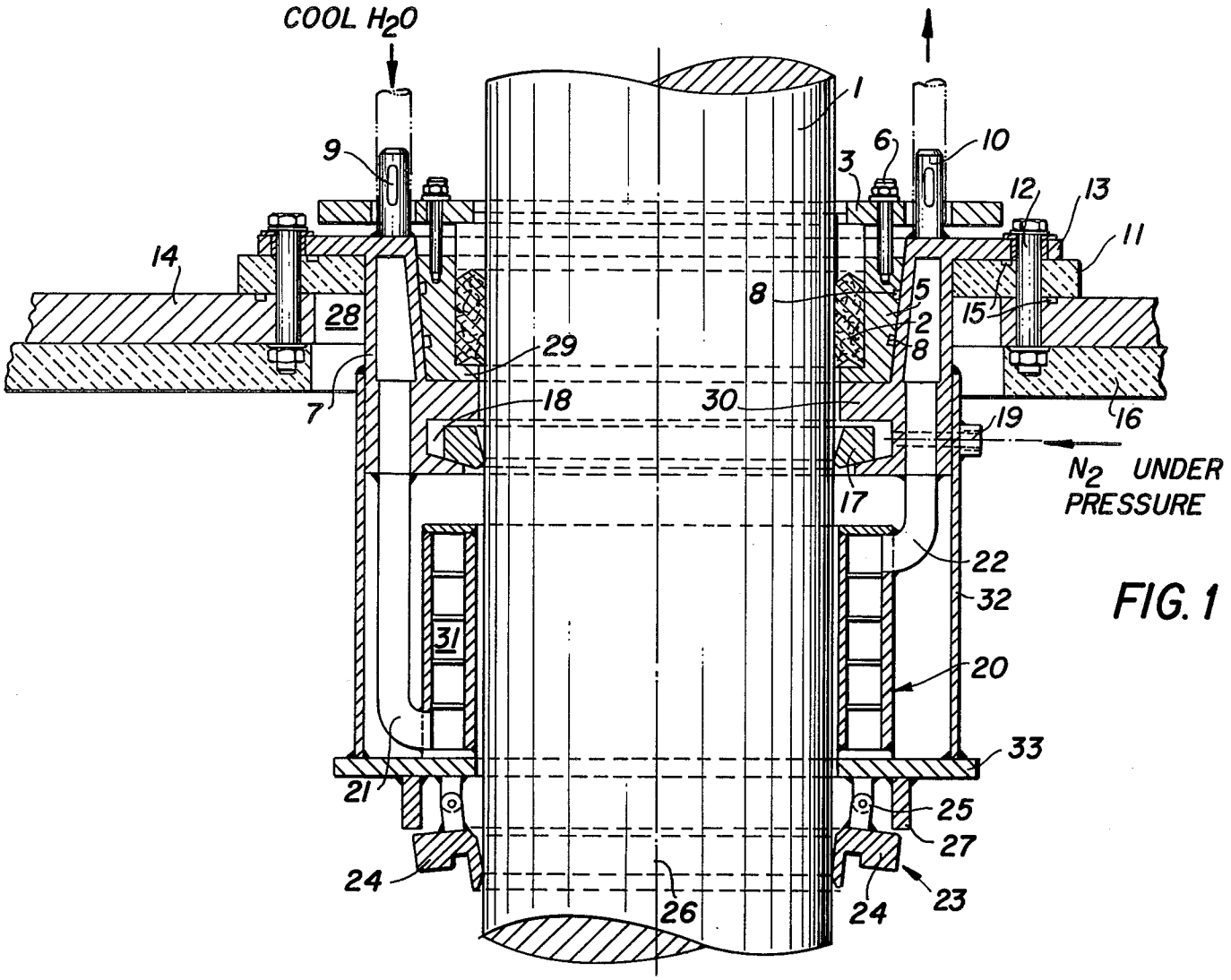

As seen in the drawing an electrode 1 is centered on a normally vertical axis 26 and passes through a hole 28 in the metallic wall 14 of a furnace. The inside surface of the wall 14 is covered by a layer 16 of ceramic fibers. An electrically insulating washer 11 is provided on the outside of the furnace wall 14 and a main support ring 7 overlies this washer 11. Bolts 12 passing through insulating T-shaners 13 secure the ring 7 and washer 11 to the outside furnace wall around the hole 28 and seals 15 prevent any leakage between these elements, which are generally permanently mounted in place.

A holder ring 5 sealed on the support ring 7 by O-rings 8 has a lip 29 and carries a pair of carbon-fiber rings 2 that bear axially downward and inward on the lip 29. A packing ring 4 which is normally split in two parts is pressed down onto the outermost seal ring 2 by a washer 3 that itself can be pulled down tight by bolts 6 in standard packing-nut fashion. Axial compression of these rings 2 forces them radially toward the axis 26 into tight contact with the cylindrical rod electrode 1 and away from the rod into tight sealing contact with the holder ring 5. The support ring 7 in turn carries axis-parallel mounting pins 10 engaging through the washer 3. Keys or wedges 9 engaged through these pins 10 hold the entire packing assembly 2—6 in place on the furnace.

Axially inward of the carbon-fiber rings 2 the main support ring 7 is formed with a groove 18 open toward the axis 26 and receiving a multipart and rigid containment ring 17 that engages the outer surface of the rod electrode 1 in snug line contact. The bottom surface of the groove 18 is sloped, as is that of the ring 17, so that the ring 17 is urged by gravity into snug contact with the rod 1 and support ring 7. This forms an annular chamber 30 bounded axially by the rings 2 and 17 and radially of the axis 26 by the rod 1 and support ring 7. An inlet passage 19 serves for introduction of a gas, normally nitrogen, under superatmospheric pressure into this chamber 30. This inert gas therefore effectively prevents leakage along the electrode 1 out of the chamber, while protecting the seal rings 2.

Inward of the furnace along the axis 26 the system is provided with a cylindrically tubular jacket 20 spacedly and coaxially surrounding the electrode 1 and having an internal spiral passage 31 that is fed via a conduit 21 with cool water and from which the water is drawn off by another conduit 22, both of these conduits passing through the support ring 7. To support this jacket 20 the support ring 7 is provided with a large-diameter shield tube or sleeve 32 completely surrounding the jacket 20 and containing the inner ends of the conduits 21 and 22, and having an inner-end plate 33 on which the jacket 20 is fixed. The inner periphery of this plate 33 is spaced out slightly from the electrode 1.

On its inner face the plate 33 carries a shield ring 23 formed of a plurality, here four, of identical segments 24 pivoted at 25 and counterweighted to tip into radial contact with the electrode 1. This ring 23 shields the jacket 20 and other seal-assembly parts from the considerable radiant energy inside the furnace. Abutments 27 are provided on the ring 33 to prevent excessive outward tipping of the pivotal ring segments 24 as, for instance, could occur when the furnace is tipped to pour out a melt and the electrode 1 moves into a somewhat skew position.

With this system the electrode 1 can be replaced easily and rapidly. The wedges 2 are merely pulled out, and the electrode with the entire packing unit 2—6 is pulled up and out of the assembly. A new electrode 1 with a fresh packing unit 2—6 is then inserted in its place and the wedges 9 are driven tight to complete the switch. This operation can be done very rapidly, without even waiting for the old electrode to cool off between heats. Thus not only does the instant invention provide a tight and long-lived seal, but it also makes servicing and changing of the electrode very easy.

It will be understood that each of the elements described above, or two or more together, may also find a useful application in other types of constructions differing from the types described above.

While the invention has been illustrated and described as embodied in an electrode seal assembly for metallurgical furnace, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristic of the generic or specific aspects of this invention.

What is claimed as new and desired to be protected by Letters Patent is set forth in the appended claims.

1. A seal for use around a rod electrode passing along an axis through a hole in the wall of a furnace into the interior of the furnace, the seal comprising:

an annular and at least limitedly flexible seal ring fitted snugly around the electrode in the hole;

a holder carrying the seal ring and sealingly engaged with the furnace wall, whereby gas flow through the wall at the hole past the seal ring is substantially blocked;

structure forming with the electrode and seal ring a substantially closed chamber surrounding the electrode axially inward into the furnace from the ring;

means for pressurizing the chamber at superatmospheric pressure with a gas; and means for cooling the electrode inward of the furnace from the seal ring.

2. The furnace electrode seal defined in claim 1, further comprising:

packing means on said holder for compressing the seal ring axially for pressing the ring radially against the electrode.

3. The furnace electrode seal defined in claim 2, wherein the seal ring includes two axially stacked rings.

4. The furnace electrode seal defined in claim 2, wherein the seal ring is of carbon.

5. The furnace electrode seal defined in claim 2, wherein the packing means include rigid compression rings bearing axially on the seal ring.

6. The furnace electrode seal defined in claim 5, wherein the compression rings are split.

7. The furnace electrode seal defined in claim 5, wherein the structure includes a containment ring inward of the furnace from the seal ring and radially engaging the electrode.

8. The furnace electrode seal defined in claim 7, wherein the containment ring is generally equiangularly divided into a plurality of parts engaging radially against the electrode.

9. The furnace electrode seal defined in claim 7, wherein the structure further includes a sleeve carrying and extending axially between the seal and containment rings, whereby the chamber is delimited radially toward the axis by the electrode, radially away from the axis by the sleeve, axially inward of the furnace by the containment ring, and axially outward of the furnace by the seal ring.

10. The furnace electrode seal defined in claim 8, wherein the cooling means includes an annular jacket surrounding the electrode inward of the furnace from the chamber and means for circulating a coolant through the jacket.

11. The furnace electrode seal defined in claim 10, wherein the jacket is cylindrically tubular and hollow and is provided internally with a spiral passage through which the coolant is passed.

12. The furnace electrode seal defined in claim 10, wherein the jacket spacedly surrounds the electrode.

13. The furnace electrode seal defined in claim 1, further comprising a shield ring inward of the furnace along the electrode from the chamber and cooling means and radially engaging the electrode, whereby the shield ring protects the cooling means from radiant heat.

14. The furnace electrode seal defined in claim 13, wherein the shield ring has a plurality of pivotal ring parts radially engaging the electrode.

15. The furnace electrode seal defined in claim 14, further comprising a shield tube extending inward into the furnace around the electrode from the holder and containing the structure forming the chamber and the cooling means, the shield ring being carried on the inner end of the shield tube.

16. The furnace electrode seal defined in claim 14, wherein the ring parts are weighted to pivot against the electrode.

* * * * *